US008219409B2

(12) United States Patent
Vetterli et al.

(10) Patent No.: US 8,219,409 B2
(45) Date of Patent: Jul. 10, 2012

(54) AUDIO WAVE FIELD ENCODING

(75) Inventors: Martin Vetterli, Grandvaux (CH); Francisco Pereira Correia Pinto, Ecublens VD (PT)

(73) Assignee: Ecole Polytechnique Federale De Lausanne, Lausanne (CH)

( * ) Notice: Subject to any disclaimer, the term of this patent is extended or adjusted under 35 U.S.C. 154(b) by 1136 days.

(21) Appl. No.: 12/058,988

(22) Filed: Mar. 31, 2008

(65) Prior Publication Data

US 2009/0248425 A1 Oct. 1, 2009

(51) Int. Cl.

| | |
|---|---|
| ***G10L 21/04*** | (2006.01) |
| ***G10L 19/00*** | (2006.01) |
| ***G10L 11/00*** | (2006.01) |
| ***G10L 19/14*** | (2006.01) |
| ***G10L 11/04*** | (2006.01) |

(52) U.S. Cl. ..... 704/503; 704/501; 704/502; 704/504; 704/220; 704/200.1; 704/200; 704/211; 704/205; 704/206; 704/500

(58) Field of Classification Search ..... 704/501–504, 704/200, 211, 220, 200.1, 223, 205, 206, 704/500; 381/310, 94.02; 700/94
See application file for complete search history.

(56) References Cited

U.S. PATENT DOCUMENTS

| | | | | |
|---|---|---|---|---|
| 5,535,300 | A | 7/1996 | Hall, II et al. | |
| 5,579,430 | A | 11/1996 | Grill et al. | |
| 5,924,060 | A | 7/1999 | Brandenburg | |
| 2005/0175197 | A1* | 8/2005 | Melchior et al. | 381/310 |
| 2005/0207592 | A1* | 9/2005 | Sporer et al. | 381/94.2 |
| 2006/0074642 | A1* | 4/2006 | You | 704/222 |
| 2006/0074693 | A1* | 4/2006 | Yamashita | 704/500 |
| 2009/0067647 | A1* | 3/2009 | Yoshizawa et al. | 381/119 |
| 2009/0157411 | A1* | 6/2009 | Kim et al. | 704/500 |
| 2009/0292544 | A1* | 11/2009 | Virette et al. | 704/501 |

FOREIGN PATENT DOCUMENTS

WO WO-8801811 3/1988

OTHER PUBLICATIONS

Horbach, U.; Corteel, E.; Pellegrini, R.S.; Hulsebos, E.; , "Real-time rendering of dynamic scenes using wave field synthesis," Multimedia and Expo, 2002. ICME '02. Proceedings. 2002 IEEE International Conference on , vol. 1, No., pp. 517-520 vol. 1, 2002.*

T. Ajdler, L. Sbaiz, and M. Vetterli, "The plenacoustic function and its sampling," in IEEE Transactions on Signal Processing, 2006, vol. 54, pp. 3790-3804.*

N. Jayant, J. Johnston, and R. Safranek, "Signal compression based on models of human perception", Proc. IEEE, vol. 81, No. 10, 1993.*

(Continued)

*Primary Examiner* — Douglas Godbold
*Assistant Examiner* — Edgar Guerra-Erazo
(74) *Attorney, Agent, or Firm* — Blank Rome LLP

(57) ABSTRACT

An encoder/decoder for multi-channel audio data, and in particular for audio reproduction through wave field synthesis. The encoder comprises a two-dimensional filter-bank to the multi-channel signal, in which the channel index is treated as an independent variable as well as time, and and the resulting spectral coefficient are quantized according to a two-dimensional psychoacoustic model, including masking effect in the spatial frequency as well as in the temporal frequency. The coded spectral data are organized in a bitstream together with side information containing scale factors and Huffman codebook identifiers.

28 Claims, 3 Drawing Sheets

OTHER PUBLICATIONS

R. Väänänen, O. Warusfel, and M. Emerit, "Encoding and rendering of perceptual sound scenes in the CARROUSO project", Proc. AES 22nd Int. Conf. (Virtual, Synthetic, and Entertainment Audio), pp. 289-297, Jun. 2002).*

A. Tirakis, A. Delopoulos, and S. Kollias, "Two-dimensional filter bank design for optimal reconstruction using limited subband information", IEEE Trans. Image Processing, vol. 4, pp. 1160-1165 , 1995.*

H. Purnhagen, "An Overview of MPEG-4 Audio Version 2," AES 17th International Conference, Sep. 2-5, 1999, Florence, Italy.*

R. Väänänen "User interaction and authoring of 3D sound scenes in the Carrouso EU project", 114th Convention of the Audio Engineering Society (AES), Amsterdam, Mar. 2003.*

Pinto, F.; Vetterli, M.; , "Wave Field coding in the spacetime frequency domain," Acoustics, Speech and Signal Processing, 2008. ICASSP 2008. IEEE International Conference on , vol., No., pp. 365-368, Mar. 31, 2008-Apr. 4, 2008.*

Väljamäe, A. (2003). A feasibility study regarding implementation of holographic audio rendering techniques over broadcast networks. (Master thesis, Chalmers Technical University, 2003).*

* cited by examiner

AUDIO WAVE FIELD ENCODING

FIELD OF THE INVENTION

The present invention relates to a digital encoding and decoding for storing and/or reproducing sampled acoustic signals and, in particular, signal that are sampled or synthesized at a plurality of positions in space and time. The encoding and decoding allows reconstruction of the acoustic pressure field in a region of area or of space.

DESCRIPTION OF RELATED ART

Reproduction of audio through Wave Field Synthesis (WFS) has gained considerable attention, because it offers to reproduce an acoustic wave field with high accuracy at every location of the listening room. This is not the case in traditional multi-channel configurations, such as Stereo and Surround, which are not able to generate the correct spatial impression beyond an optimal location in the room—the sweet spot. With WFS, the sweet spot can be extended to enclose a much larger area, at the expense of an increased number of loudspeakers.

The WFS technique consists of surrounding the listening area with an arbitrary number of loudspeakers, organized in some selected layout, and using the Huygens-Fresnel principle to calculate the drive signals for the loudspeakers in order to replicate any desired acoustic wave field inside that area. Since an actual wave front is created inside the room, the localization of virtual sources does not depend on the listener's position.

A typical WFS reproduction system comprises both a transducer (loudspeaker) array, and a rendering device, which is in charge of generating the drive signals for the loudspeakers in real-time. The signals can be either derived from a microphone array at the positions where the loudspeakers are located in space, or synthesized from a number of source signals, by applying known wave equation and sound processing techniques. FIG. 1 shows two possible WFS configurations for the microphone and sources array. Several others are however possible.

The fact that WFS requires a large amount of audio channels for reproduction presents several challenges related to processing power and data storage or, equivalently, bitrate. Usually, optimally encoded audio data requires more processing power and complexity for decoding, and vice-versa. A compromise must therefore be struck between data size and processing power in the decoder.

Coding the original source signals provides, potentially, consistent reduction of data storage with respect to coding the sound field at a given number of locations in space. These algorithms are, however very demanding in processing power for the decoder, which is therefore more expensive and complex. The original sources, moreover, are not always available and, even when they are, it may not be desirable, from a copyright protection standpoint, to disclose them.

Several encodings and decoding schemes have been proposed and used, and they can yield, in many cases, substantial bitrate reductions. Among others, suitable for encoding methods systems described in WO8801811 international application, as well as in U.S. Pat. Nos. 5,535,300 and 5,579,430 patents, which rely on a spectral representation of the audio signal, in the use of psycho-acoustic modelling for discarding information of lesser perceptual importance, and in entropy coding for further reducing the bitrate. While these methods have been extremely successful for conventional mono, stereo, or surround audio recordings, they can not be expected to deliver optimal performance if applied individually to a large number of WFS audio channels.

There is accordingly a need for audio encoding and decoding methods and systems which are able to store the WFS information in a bitstream with a favorable reduction in bitrate and that is not too demanding for the decoder.

BRIEF SUMMARY OF THE INVENTION

According to the invention, these aims are achieved by means of the encoding method, the decoding method, the encoding and decoding devices and software, the recording system and the reproduction system that are the object of the appended claims.

In particular the aims of the present invention are achieved by a method for encoding a plurality of audio channels comprising the steps of: applying to said plurality of audio channels a two-dimensional filter-bank along both the time dimension and the channel dimension resulting in two-dimensional spectra; coding said two-dimensional spectra, resulting in coded spectral data.

The aims of the present invention are also attained by a method for decoding a coded set of data representing a plurality of audio channels comprising the steps of: obtain a reconstructed two-dimensional spectra from the coded data set; transforming the reconstructed two-dimensional spectra with a two-dimensional inverse filter-bank.

According to another aspect of the same invention, the aforementioned goals are met by an acoustic reproduction system comprising: a digital decoder, for decoding a bitstream representing samples of an acoustic wave field or loudspeaker drive signals at a plurality of positions in space and time, the decoder including an entropy decoder, operatively arranged to decode and decompress the bitstream, into a quantized two-dimensional spectra, and a quantization remover, operatively arranged to reconstruct a two-dimensional spectra containing transform coefficients relating to a temporal-frequency value and a spatial-frequency value, said quantization remover applying a masking model of the frequency masking effect along the temporal frequency and/or the spatial frequency, and a two-dimensional inverse filter-bank, operatively arranged to transform the reconstructed two-dimensional spectra into a plurality of audio channels; a plurality of loudspeaker or acoustical transducers arranged in a set disposition in space, the positions of the loudspeakers or acoustical transducers corresponding to the position in space of the samples of the acoustic wave field; one or more DACs and signal conditioning units, operatively arranged to extract a plurality of driving signals from plurality of audio channels, and to feed the driving signals to the loudspeakers or acoustical transducers.

Further the invention also comprises an acoustic registration system comprising: a plurality of microphones or acoustical transducers arranged in a set disposition in space to sample an acoustic wave field at a plurality of locations; one or more ADC's, operatively arranged to convert the output of the microphones or acoustical transducers into a plurality of audio channels containing values of the acoustic wave field at a plurality of positions in space and time; a digital encoder, including a two-dimensional filter bank operatively arranged to transform the plurality of audio channels into a two-dimensional spectra containing transform coefficients relating to a temporal-frequency value and a spatial-frequency value, a quantizing unit, operatively arranged to quantize the two-dimensional spectra into a quantized two-dimensional spectra, said quantizing applying a masking model of the frequency masking effect along the temporal frequency and/or the spatial frequency, and an entropy coder, for providing a compressed bitstream representing the acoustic wave field or the loudspeaker drive signals; a digital storage unit for recording the compressed bitstream.

The aims of the invention are also achieved by an encoded bitstream representing a plurality of audio channels including a series of frames corresponding to two-dimensional signal blocks, each frame comprising: entropy-coded spectral coefficients of the represented wave field in the corresponding two-dimensional signal block, the spectral coefficients being quantized according to a two-dimensional masking model, and allowing reconstruction of the wave field or the loudspeaker drive signal by a two-dimensional filter-bank, side information necessary to decode the spectral data.

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS OF THE INVENTION

The acoustic wave field can be modeled as a superposition of point sources in the three-dimensional space of coordinates (x, y, z). We assume, for the sake of simplicity, that the point sources are located at z=0, as is often the case. This should not be understood, however, as a limitation of the present invention. Under this assumption, the three dimensional space can be reduced to the horizontal xy-plane. Let p(t,r) be the sound pressure at r=(x,y) generated by a point source located at $r_s=(x_s,y_s)$. The theory of acoustic wave propagation states that $$p(t, r) = \frac{1}{\|r - r_s\|} s\left(t - \frac{\|r - r_s\|}{c}\right) \tag{1}$$

where s(t) is the temporal signal driving the point source, and c is the speed of sound. We note that the acoustic wave field could also be described in terms of the particle velocity v(t,r), and that the present invention, in its various embodiments, also applies to this case. The scope of the present invention is not, in fact, limited to a specific wave field, like the fields of acoustic pressure or velocity, but includes any other wave field.

Generalizing (1) to an arbitrary number of point sources, $s_0$, $s_1, \ldots, s_{s-1}$, located at $r_0, r_1, \ldots, r_{s-1}$, the superposition principle implies that $$p(t, r) = \sum_{k=0}^{S-1} \frac{1}{\|r - r_k\|} s_k\left(t - \frac{\|r - r_k\|}{c}\right) \tag{2}$$

Figure 1:
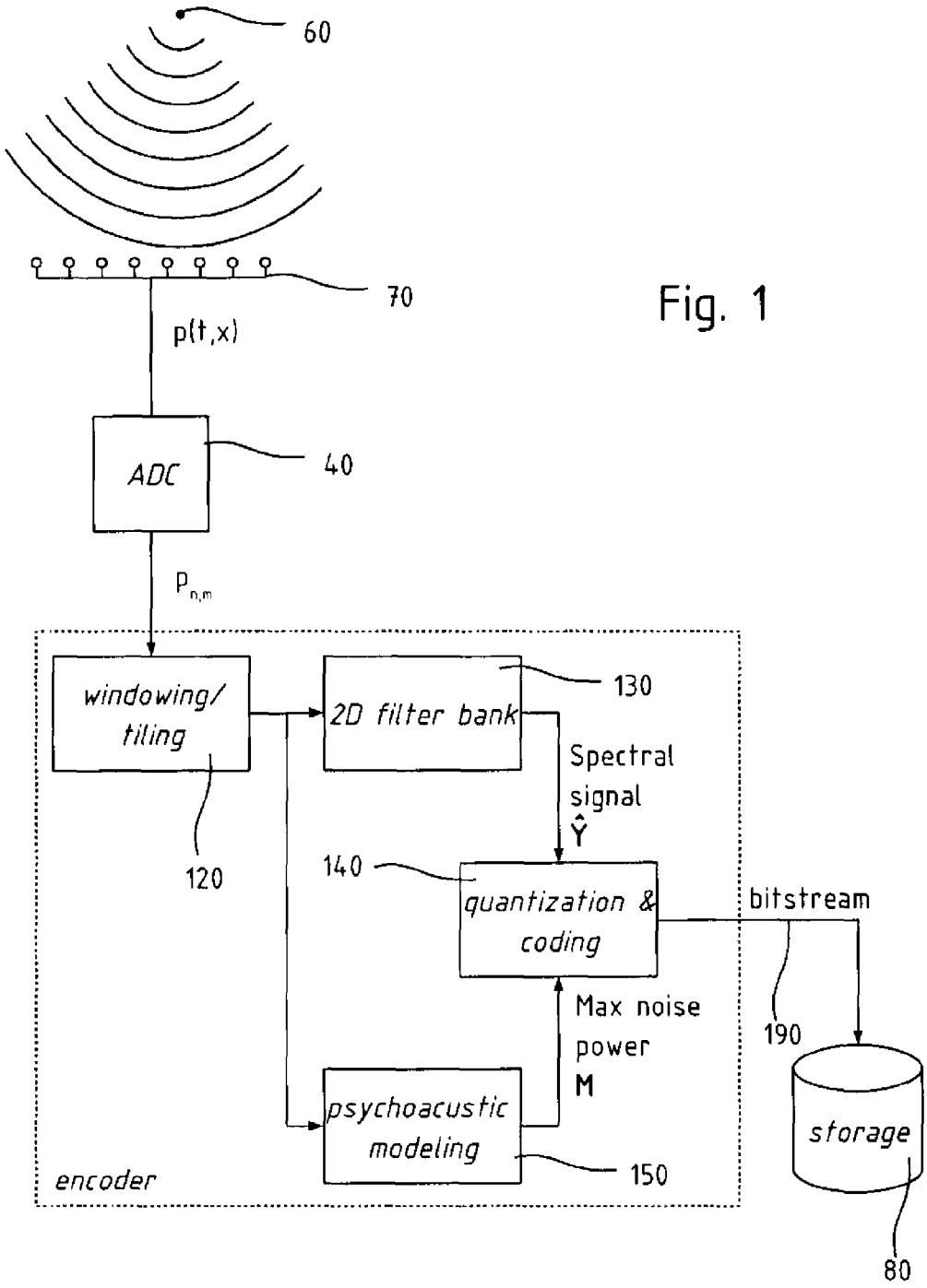
FIG. 1 shows, in a simplified schematic way, an acoustic registration system according to an aspect of the present invention.

FIG. 1 represents an example WFS recording system according to one aspect of the present invention, comprising a plurality of microphones 70 arranged along a set disposition in space. In this case, for simplicity, the microphones are on a straight line coincident with the x-axis. The microphones 70 sample the acoustic pressure field generated by an undefined number of sources 60. If p(t,r) is measured on the x-axis, (2) becomes $$p(t, x) = \sum_{k=0}^{S-1} \frac{1}{\|x - r_k\|} s_x\left(t - \frac{\|x - r_k\|}{c}\right) \tag{3}$$

which we call the continuous-spacetime signal, with temporal dimension t and spatial dimension x. In particular, if $\|r_k\| >> \|r\|$ for all k, then all point sources are located in far-field, and thus $$p(t, x) \approx \sum_{k=0}^{S-1} \frac{1}{\|r_k\|} s_k\left(t + \frac{\cos\alpha_k}{c} x - \frac{\|r_k\|}{c}\right) \tag{4}$$

since $\|x-r_k\| \approx \|r_k\| - x \cos \alpha_k$, where $\alpha_k$ is the angle of arrival of the plane wave-front k. If (4) is normalized and the initial delay discarded, the terms $\|r_k\|^{-1}$ and $c^{-1}\|r_k\|$ can be removed.

Frequency Representation

The spacetime signal p(t,x) can be represented as a linear combination of complex exponentials with temporal frequency Ω and spatial frequency Φ, by applying a spatio-temporal version of the Fourier transform:

$$P(\Omega,\Phi) = \int_{-\infty}^{\infty}\int_{-\infty}^{\infty} p(t,x) e^{-j(\Omega t + \Phi x)} dt dx \tag{5}$$

which we call the continuous-space-time spectrum. It is important to note, however, that the spacetime signal can be spectrally decomposed also with respect to other base function than the complex exponential of the Fourier base. Thus it could be possible to obtain a spectral decomposition of the spacetime signal in spatial and temporal cosine components (DCT transformation), in wavelets, or according to any other suitable base. It may also be possible to choose different bases for the space axes and for the time axis. These representations generalize the concepts of frequency spectrum and frequency component and are all comprised in the scope of the present invention.

Figure 6:
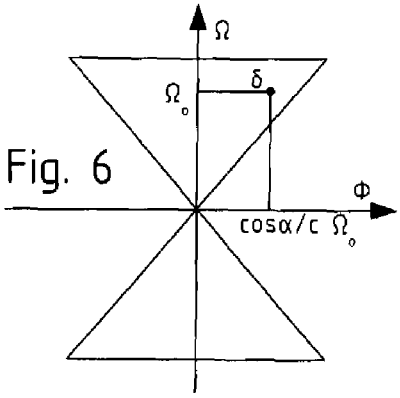
FIGS. 6 and 7 show examples of space-time frequency spectra.
Figure 7:
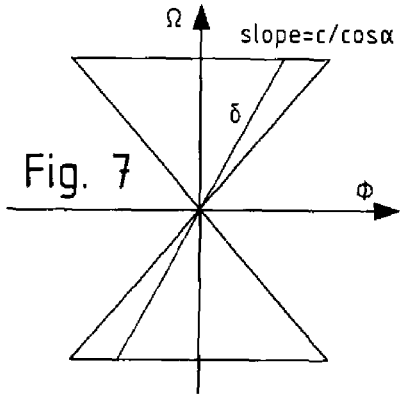

Consider the space-time signal p(t,x) generated by a point source located in far-field, and driven by s(t). According to (4)

$$p(t, x) = s\left(t + \frac{\cos\alpha}{c} x\right) \tag{6}$$

where, for simplicity, the amplitude was normalized and the initial delay discarded. The Fourier transform is then $$P(\Omega, \Phi) = S(\Omega)\delta\left(\Phi - \frac{\cos\alpha}{c}\Omega\right) \tag{7}$$

which represents, in the space-time frequency domain, a wall-shaped Dirac function with slope c/cos α and weighted by the one-dimensional spectrum of s(t). In particular, if $s(t)=e^{j\Omega_o t}$, $$P(\Omega, \Phi) = \delta(\Omega - \Omega_o)\delta\left(\Phi - \frac{\cos\alpha}{c}\Omega_o\right) \tag{8}$$

which represents a single spatio-temporal frequency centered at $$\left(\Omega_o, \frac{\cos\alpha}{c}\Omega_o\right),$$

as shown in FIG. 6. Also, if $s(t)=\delta(t)$, then $$P(\Omega, \Phi) = \delta\left(\Phi - \frac{\cos\alpha}{c}\Omega\right) \tag{9}$$

as shown in FIG. 7

If the point source is not far enough from the x-axis to be considered in far-field, (1) must be used, such that $$p(t, x) = \frac{1}{\|x - r_s\|}\delta\left(t - \frac{\|x - r_s\|}{c}\right) \tag{10}$$

for which the space-time spectrum can be shown to be $$P(\Omega, \Phi) = -j\pi e^{-j\Phi x_s} H_o^{(1)*}\left(y_s\sqrt{\left(\frac{\Omega}{c}\right)^2 - \Phi^2}\right) \tag{11}$$

where $H_o^{(1)\star}$ represents the complex conjugate of the zero-order Hankel function of the first kind. $P(\Omega,\Phi)$ has most of its energy concentrated inside a triangular region satisfying $|\Phi| \leqq |\Omega| c^{-1}$, and some residual energy on the outside.

Note that the space-time signal p(t,x) generated by a source signal $s(t)=\delta(t)$ is in fact a Green's solution for the wave equation measured on the x-axis. This means that (9) and (11) act as a transfer function between $p(t,r_s)$ and p(t,x), depending on how far the source is away from the x-axis. Furthermore, the transition from (11) to (9) is smooth, in the sense that, as the source moves away from the x-axis, the dispersed energy in the spectrum slowly collapses into the Dirac function of FIG. 7 Further on, we present another interpretation for this phenomenon, in which the near-field wave front is represented as a linear combination of plane waves, and therefore a linear combination of Dirac functions in the spectral domain.

The simple linear disposition of FIG. 1 can be extended to arbitrary dispositions. Consider an enclosed space E with a smooth boundary on the xy-plane. Outside this space, an arbitrary number of point sources in far-field generate an acoustic wave field that equals p(t,r) on the boundary of E according to (2). If the boundary is smooth enough, it can be approximated by a K-sided polygon. Consider that x goes around the boundary of the polygon as if it were stretched into a straight line. Then, the domain of the spatial coordinate x can be partitioned in a series of windows in which the boundary is approximated by a straight segment, and (4) can be written as $$p(t, x) = \sum_{l=0}^{K_l-1} w_l(x)\sum_{k=0}^{S-1} s_k\left(t + \frac{\cos\alpha_{kl}}{c}x\right) \tag{12}$$

$$= \sum_{l=0}^{K_l-1} w_l(x)p_l(t, x) \tag{13}$$

where $\alpha_{kl}$ is the angle of arrival of the wave-front k to the polygon's side l, in a total of $K_l$ sides, and $w_l(x)$ is a rectangular window of amplitude 1 within the boundaries of side l and zero otherwise (see next section). The windowed partition $w_l(x)p_l(t,x)$ is called a spatial block, and is analogous to the temporal block w(t)s(t) known from traditional signal processing. In the frequency domain, $$P_l(\Omega,\Phi)=\int_{-\infty}^{\infty}\int_{-\infty}^{\infty} w_l(x)p_l(t,x)e^{-j(\Omega t+\Phi x)}dtdx \quad l=0, \ldots, K_l-1 \tag{14}$$

which we call the short-space Fourier transform. If a window $w_g(t)$ is also applied to the time domain, the Fourier transform is performed in spatio-temporal blocks, $w_g(t)w_l(x)p_{g,l}(t,x)$, and thus $$P_{g,l}(\Omega,\Phi)=\int_{-\infty}^{\infty}\int_{-\infty}^{\infty} w_g(t)w_l(x)\cdot p_{g,l}(t,x)e^{-j(\Omega t+\Phi x)}dtdx \quad g=0, \ldots, K_g-1, l=0, \ldots, K_l-1 \tag{15}$$

where $P_{g,l}(\Omega,\Phi)$ is the short space-time Fourier transform of block g,l, in a total of $K_g \times K_l$ blocks.

Spacetime Windowing

The short-space analysis of the acoustic wave field is similar to its time domain counterpart, and therefore exhibits the same issues. For instance, the length $L_x$ of the spatial window controls the x/Φ resolution trade-off: a larger window generates a sharper spectrum, whereas a smaller window exploits better the curvature variations along x. The window type also has an influence on the spectral shaping, including the trade-off between amplitude decay and width of the main lobe in each frequency component. Furthermore, it is beneficial to have overlapping between adjacent blocks, to avoid discontinuities after reconstruction. The WFC encoders end decoders of the present invention comprise all these aspects in a space-time filter bank.

The windowing operation in the space-time domain consists of multiplying p(t,x) both by a temporal window $w_t(t)$ and a spatial window $w_x(x)$, in a separable fashion. The lengths $L_t$ and $L_x$ of each window determine the temporal and spatial frequency resolutions.

Consider the plane wave examples of previous section, and let $w_t(t)$ and $w_x(x)$ be two rectangular windows such that $$w_t(t) = \sqcap\left(\frac{t}{L_t}\right) = \begin{cases} 1, & |t| < \frac{L_t}{2} \\ 0, & |t| > \frac{L_t}{2} \end{cases} \tag{16}$$

and the same for $w_x(x)$. In the spectral domain, $$W_t(\Omega) = L_t \operatorname{sinc}\left(\frac{L_t\Omega}{2\pi}\right) \tag{17}$$

For the first case, where $s(t)=e^{j\omega_o t}$, $$p(t, x) = e^{j\omega_o\left(t+\frac{\cos\alpha}{c}x\right)} w_t(t) w_x(x) \tag{18}$$

and thus $$P(\Omega, \Phi) = W_t(\Omega - \Omega_o) W_x\left(\Phi - \frac{\cos\alpha}{c}\Omega_o\right) \tag{19}$$

$$= L_t \operatorname{sinc}\left(\frac{L_t}{2\pi}(\Omega - \Omega_o)\right) L_x \operatorname{sinc}\left(\frac{L_x}{2\pi}\left(\Phi - \frac{\cos\alpha}{c}\Omega_o\right)\right) \tag{20}$$

For the second case, where $s(t)=\delta(t)$, $$p(t, x) = \delta\left(t + \frac{\cos\alpha}{c}x\right) w_t(t) w_x(x) \tag{21}$$

and thus $$P(\Omega, \Phi) = \frac{c}{|\cos\alpha|} W_t\left(\frac{c}{\cos\alpha}\Phi\right) *_\Phi W_x\left(\Phi - \frac{\cos\alpha}{c}\Omega\right) \tag{22}$$

$$= \frac{c}{|\cos\alpha|} L_t \operatorname{sinc}\left(\frac{L_t}{2\pi} \cdot \frac{c}{\cos\alpha}\Phi\right) *_\Phi L_x \operatorname{sinc}\left(\frac{L_x}{2\pi}\left(\Phi - \frac{\cos\alpha}{c}\Omega\right)\right) \tag{23}$$

where $\bigstar_\Phi$ denotes convolution in $\Phi$. Using $$\lim_{a\to\infty} a\operatorname{sinc}(ax) = \delta(x),$$

(23) is simplified to:

$$P(\Omega, \Phi) \approx 2\pi\delta(\Phi) *_\Phi L_x \operatorname{sinc}\left(\frac{L_x}{2\pi}\left(\Phi - \frac{\cos\alpha}{c}\Omega\right)\right) \tag{24}$$

$$= 2\pi L_x \operatorname{sinc}\left(\frac{L_x}{2\pi}\left(\Phi - \frac{\cos\alpha}{c}\Omega\right)\right) \tag{25}$$

Wave Field Coder

An example of encoder device according to the present invention is now described with reference to the FIG. 1, which illustrates an acoustic registration system including an array of microphones 70. The ADC 40 provides a sampled multichannel signal, or spacetime signal $p_{n,m}$. The system may include also, according to the need, other signal conditioning units, for example preamplifiers or equalizers for the microphones, even if these elements are not described here, for concision's sake.

The spacetime signal $P_{n,m}$ is partitioned, in spatio-temporal blocks by the windowing unit 120, and further transformed into the frequency domain by the bi-dimensional filterbank 130, for example a filter bank implementing an MDCT to both temporal and spatial dimensions. In the spectral domain, the two-dimensional coefficients $Y_{bn,bm}$ are quantized, in quantizer unit 145, according to a psychoacoustic model 150 derived for spatio-temporal frequencies, and then converted to binary base through entropy coding. Finally, the binary data is organized into a bitstream 190, together with side information 196 (see FIG. 5) necessary to decode it, and stored in storage unit 80.

Even if the FIG. 1 depicts a complete recording system, the present invention also include a standalone encoder, implementing the sole two-dimensional filter bank 130 and the quantizer 145 according to a psychoacoustic model 150, as well as the corresponding encoding method.

The present invention also includes an encoder producing a bitstream that is broadcast, or streamed on a network, without being locally stored. Even if the different elements 120, 130, 145, 150 making up the encoder are represented as separate physical block, they may also stand for procedural steps or software resources, in embodiments in which the encoder is implemented by a software running on a digital processor.

Figure 2:
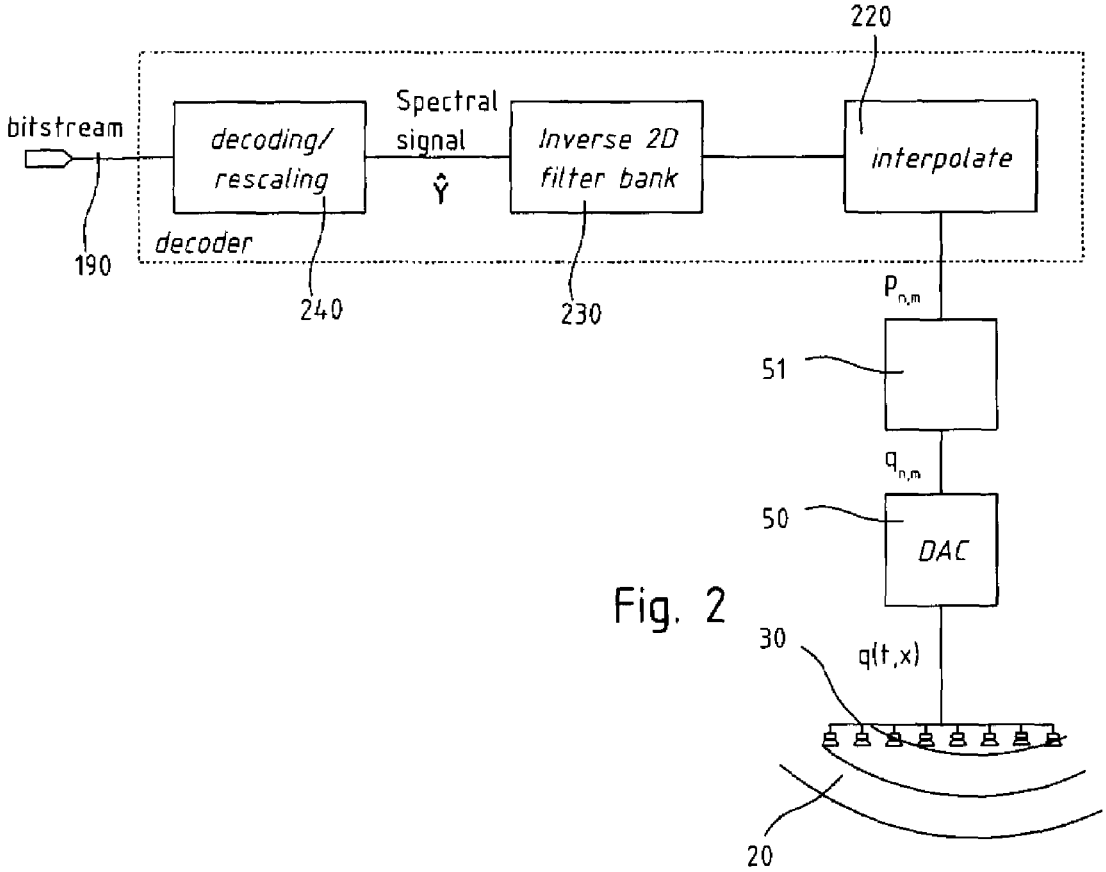
FIG. 2 illustrates, in a simplified schematic way, an acoustic reproduction system according to another object of the present invention.

On the decoder side, described now with reference to the FIG. 2, the bitstream 190 is parsed, and the binary data converted, by decoding unit 240 into reconstructed spectral coefficients $Y_{bn,bm}$, from which the inverse filter bank 230 recovers the multichannel signal in time and space domains. The interpolation unit 220 is provided to recompose the interpolated acoustic wave field signal p(n,m) from the spatio-temporal blocks.

The drive signals q(n,m) for the loudspeakers 30 are obtained by processing the acoustic wave field signal p(n,m) in filter block 51. This can be obtained, for example, by a simple high-pass filter, or by a more elaborate filter taking the specific responses of the loudspeaker and/or of the microphones into account, and/or by a filter that compensates the approximations made from the theoretical synthesis model, which requires an infinite number of loudspeakers on a three-dimensional surface. The DAC 50 generates a plurality of continuous (analogue) drive signals q(t), and loudspeakers 30 finally generate the reconstructed acoustic wave field 20. The function of filter block 51 could also be obtained, in equivalent manner, by a bank of analogue filters below the DAC unit 50.

In practical implementations of the invention, the filtering operation could also be carried out, in equivalent manner, in the frequency domain, on the two-dimensional spectral coefficients $Y_{bn,bm}$. The generation of the driving signals could also be done, either in the time domain or in the frequency domain, at the encoder's side, encoding a discrete multichannel drive signal q(n,m) derived from the acoustic wave field signal p(n,m). Hence the block 51 could be also placed before the inverse 2D filter bank or, equivalently, before or after 2D filter bank 130 in FIG. 1.

The FIGS. 1 and 2 represent only particular embodiment of the invention in a simplified schematic way, and that the block drawn therein represent abstract element that are not necessarily present as recognizable separate entity in all the realizations of the invention. In a decoder according to the invention, for example, the decoding, filtering and inverse filterbank transformation could be realized by a common software module.

As mentioned with reference to the encoder, the present invention also include a standalone decoder, implementing the sole decoding unit 240 and two-dimensional inverse filter bank 230, which may be realized in any known way, by hardware, software, or combinations thereof.

Sampling and Reconstruction

In most practical applications, p(t,x) can only be measured on discrete points along the x-axis. A typical scenario is when the wave field is measured with microphones, where each microphone represents one spatial sample. If $s_k(t)$ and $r_k$ are known, p(t,x) may also be computed through (3).

Figure 8A:
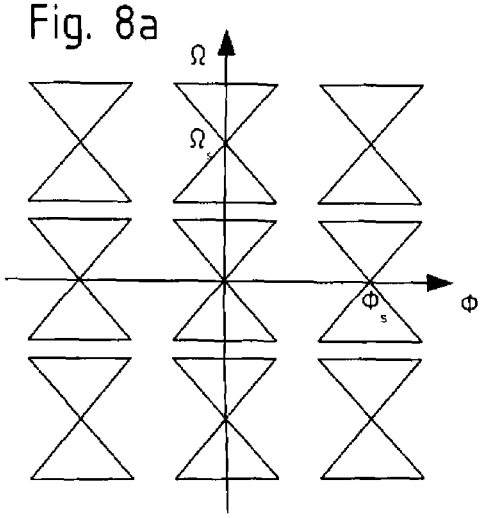
FIGS. 8*a* and 8*b* shows, in a simplified diagrammatic form, the concept of spatiotemporal aliasing.
Figure 8B:
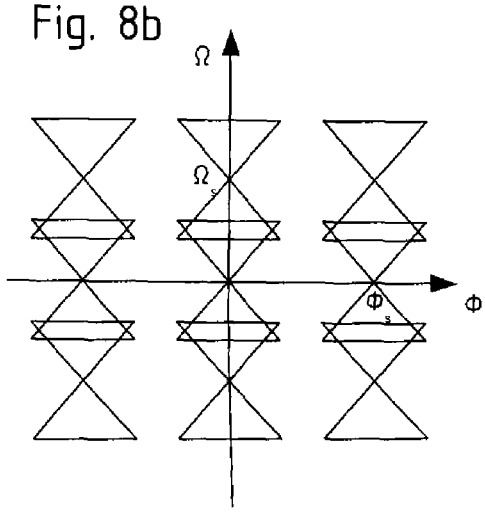

The discrete-spacetime signal $p_{n,m}$, with temporal index n and spatial index m, is defined as $$p_{n,m} = p\left(n\frac{2\pi}{\Omega_S}, m\frac{2\pi}{\Phi_S}\right) \tag{26}$$

where $\Omega_s$ and $\Phi_s$ are the temporal and spatial sampling frequencies. We assume that both temporal and spatial samples are equally spaced. The sampling operation generates periodic repetitions of $P(\Omega,\Phi)$ in multiples of $\Omega_s$ and $\Phi_s$, as illustrated in FIGS. 8*a* and 8*b*. Perfect reconstruction of p(t,x) requires that $\Omega_s \geqq 2\Omega_{max}$ and $\Phi_s \geqq 2\Phi_{max} = 2\Omega_{max}c^{-1}$, which happens only if $P(\Omega,\Phi)$ is band-limited in both $\Omega$ and $\Phi$. While this may be the case for mono signals, in the case of space-time signals a certain amount of spatial aliasing can not be avoided in general.

Spacetime-Frequency Mapping

According to the present invention, the actual coding occurs in the frequency domain, where each frequency pair $(\Omega,\Phi)$ is quantized and coded, and then stored in the bitstream. The transformation to the frequency domain is performed by a two-dimensional filterbank that represents a space-time lapped block transform. For simplicity, we assume that the transformation is separable, i.e., the individual temporal and spatial transforms can be cascaded and interchanged. In this example, we assume that the temporal transform is performed first.

Let $p_{n,m}$ be represented in a matrix notation, $$P = \begin{bmatrix} p_{0,0} & p_{0,1} & \cdots & p_{0,M-1} \\ p_{1,0} & p_{1,1} & \cdots & p_{1,M-1} \\ \vdots & \vdots & \ddots & \vdots \\ p_{N-1,0} & p_{N-1,1} & \cdots & p_{N-1,M-1} \end{bmatrix} \tag{27}$$

where N and M are the total number of temporal and spatial samples, respectively. If the measurements are performed with microphones, then M is the number of microphones and N is the length of the temporal signal received in each microphone. Let also $\tilde{\Psi}$ and $\tilde{Y}$ be two generic transformation matrices of size N×N and M×M, respectively, that generate the temporal and space-time spectral matrices X and Y. The matrix operations that define the space-time-frequency mapping can be organized as follows:

TABLE 1

| | Temporal | Spatial |
|---|---|---|
| Direct transform | $X = \tilde{\Psi}^T P$ | $Y = X\tilde{Y}$ |
| Inverse transform | $\hat{P} = \tilde{\Psi}\hat{X}$ | $\hat{X} = \hat{Y}\tilde{Y}^T$ |

The matrices $\hat{X}$, $\hat{Y}$, and $\hat{P}$ are the estimations of X, Y, and P, and have size N×M. Combining all transformation steps in the table yields $\hat{P} = \tilde{\Psi}\tilde{\Psi}^T \cdot P \cdot \tilde{Y}\tilde{Y}^T$, and thus perfect reconstruction is achieved if $\tilde{\Psi}\tilde{\Psi}^T = I$ and $\tilde{Y}\tilde{Y}^T = I$, i.e., if the transformation matrices are orthonormal.

According to a preferred variant of the invention, the WFC scheme uses a known orthonormal transformation matrix called the Modified Discrete Cosine Transform (MDCT), which is applied to both temporal and spatial dimensions. This is not, however an essential feature of the invention, and the skilled person will observe that also other orthogonal transform, providing frequency-like coefficient, could also serve. In particular, the filter bank used in the present invention could be based, among others, on Discrete Cosine transform (DCT), Fourier Transform (FT), wavelet transform, and others.

The transformation matrix $\tilde{\Psi}$ (or $\tilde{Y}$ for space) is defined by $$\tilde{\Psi} = \begin{bmatrix} \Psi_1 & & \\ \Psi_0 & \Psi_1 & \\ & \Psi_0 & \ddots \\ & & \ddots \end{bmatrix} \tag{28}$$

and has size N×N (or M×M). The matrices $\Psi_0$ and $\Psi_1$ are the lower and upper halves of the transpose of the basis matrix $\Psi$, which is given by $$\psi_{b_n,2B-1-n} = w_n\sqrt{\frac{2}{B_n}}\cos\left[\frac{\pi}{B_n}\cdot\left(n+\frac{B_n+1}{2}\right)\left(b_n+\frac{1}{2}\right)\right] \tag{29}$$

$$b_n = 0, 1, \ldots, B_n - 1;\ n = 0, 1, \ldots, 2B_n - 1,$$

where n (or m) is the signal sample index, $b_n$ (or $b_m$) is the frequency band index, $B_n$ (or $B_m$) is the number of spectral samples in each block, and $w_n$ (or $w_m$) is the window sequence. For perfect reconstruction, the window sequence must satisfy the Princen-Bradley conditions, $$w_n = w_{2B_n-1-n} \text{ and } w_n^2 + w_{n+B_n}^2 = 1$$

Note that the spatio-temporal MDCT generates a transform block of size $B_n \times B_m$ out of a signal block of size $2B_n \times 2B_m$, whereas the inverse spatio-temporal MDCT restores the signal block of size $2B_n \times 2B_m$ out of the transform block of size $B_n \times B_m$. Each reconstructed block suffers both from time-domain aliasing and spatial-domain aliasing, due to the downsampled spectrum. For the aliasing to be canceled in reconstruction, adjacent blocks need to be overlapped in both time and space. However, if the spatial window is large enough to cover all spatial samples, a DCT of Type IV with a rectangular window is used instead.

One last important note is that, when using the spatio-temporal MDCT, if the signal is zero-padded, the spatial axis requires $K_lB_m + 2B_m$ spatial samples to generate $K_lB_m$ spectral coefficients. While this may not seem much in the temporal domain, it is actually very significant in the spatial domain because $2B_m$ spatial samples correspond to $2B_m$ more channels, and thus $2B_mN$ more space-time samples. For this reason, the signal is mirrored in both domains, instead of zero-padded, so that no additional samples are required.

Preferably the blocks partition the space-time domain in a four-dimensional uniform or non-uniform tiling. The spectral coefficients are encoded according to a four-dimensional tiling, comprising the time-index of the block, the spatial-index of the block, the temporal frequency dimension, and the spatial frequency dimension.

Psychoacoustic Model

Figure 3:
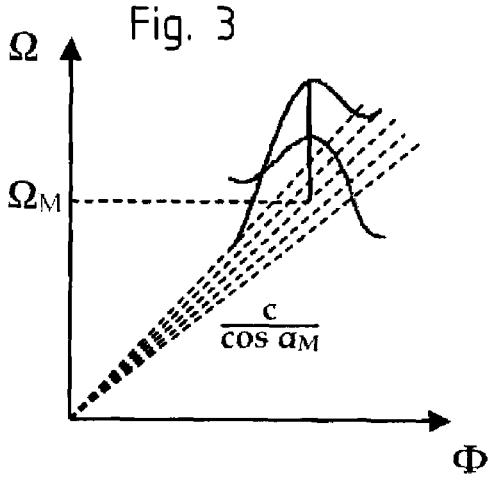
FIGS. 3 and 4 show possible forms of a 2-dimensional masking function used in a psychoacoustic model in a quantizer or in a quantization operation of the invention.
Figure 4:
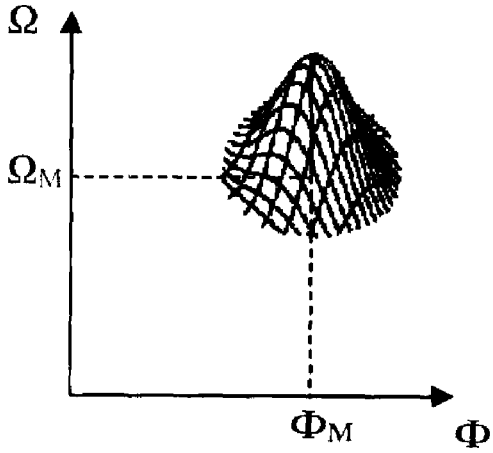

The psychoacoustic model for spatio-temporal frequencies is an important aspect of the invention. It requires the knowledge of both temporal-frequency masking and spatial-frequency masking, and these may be combined in a separable or non-separable way. The advantage of using a separable model is that the temporal and spatial contributions can be derived from existing models that are used in state-of-art audio coders. On the other hand, a non-separable model can estimate the dome-shaped masking effect produced by each individual spatio-temporal frequency over the surrounding frequencies. These two possibilities are illustrated in FIGS. 3 and 4.

The goal of the psychoacoustic model is to estimate, for each spatio-temporal spectral block of size $B_n \times B_m$, a matrix M of equal size that contains the maximum quantization noise power that each spatio-temporal frequency can sustain without causing perceivable artifacts. The quantization thresholds for spectral coefficients $Y_{bn,bm}$ are then set in order not to exceed the maximum quantization noise power. The allowable quantization noise power allows to adjust the quantization thresholds in a way that is responsive to the physiological sensitivity of the human ear. In particular the psychoacoustic model takes advantage of the masking effect, that is the fact that the ear is relatively insensitive to spectral components that are close to a peak in the spectrum. In these regions close to a peak, therefore, a higher level of quantization noise can be tolerated, without introducing audible artifacts.

The psychoacoustic models thus allow encoding information using more bits for the perceptually important spectral components, and less bits for other components of lesser perceptual importance. Preferably the different embodiments of the present invention include a masking model that takes into account both the masking effect along the spatial frequency and the masking effect along the time frequency, and is based on a two-dimensional masking function of the temporal frequency and of the spatial frequency.

Three different methods for estimating M are now described. This list is not exhaustive, however, and the present invention also covers other two-dimensional masking models.

Average Based Estimation

A way of obtaining a rough estimation of M is to first compute the masking curve produced by the signal in each channel independently, and then use the same average masking curve in all spatial frequencies.

Let $x_{n,m}$ be the spatio-temporal signal block of size $2B_n \times 2B_m$ for which M is to be estimated. The temporal signals for the channels m are $x_{n,0}, \ldots, x_{n,B_m-1}$ Suppose that M[.] is the operator that computes a masking curve, with index $b_n$ and length $B_n$, for a temporal signal or spectrum. Then, $$M = [\overline{\text{mask}} \ \ldots \ \overline{\text{mask}}] \tag{30}$$

where, $$\overline{\text{mask}} = \frac{1}{B_m}\sum_{m=0}^{B_m-1} \mathbb{M}[x_n]_m \tag{31}$$

$$= \frac{1}{B_m}\sum_{m=0}^{B_m-1} \text{mask}_m \tag{32}$$

Spatial-frequency Based Estimation

Another way of estimating M is to compute one masking curve per spatial frequency. This way, the triangular energy distribution in the spectral block Y is better exploited.

Let $x_{n,m}$ be the spatio-temporal signal block of size $2B_n \times 2B_m$, and $Y_{bn,bm}$ the respective spectral block. Then, $$M = [\text{mask}_0 \ldots \text{mask}_{B_m-1}] \tag{33}$$

where $$\text{mask}_{b_m} = M[Y_{b_n}]_{b_m} \tag{34}$$

One interesting remark about this method is that, since the masking curves are estimated from vertical lines along the Ω-axis, this is actually equivalent to coding each channel separately after decorrelation through a DCT. Further on, we show that this method gives a worst estimation of M than the plane-wave method, which is the most optimal without spatial masking consideration.

Plane-wave Based Estimation

Another, more accurate, way for estimating M is by decomposing the spacetime signal p(t,x) into plane-wave components, and estimating the masking curve for each component. The theory of wave propagation states that any acoustic wave field can be decomposed into a linear combination of plane waves and evanescent waves traveling in all directions. In the spacetime spectrum, plane waves constitute the energy inside the triangular region $|\Phi| \leqq |\Omega| c^{-1}$, whereas evanescent waves constitute the energy outside this region. Since the energy outside the triangle is residual, we can discard evanescent waves and represent the wave field solely by a linear combination of plane waves, which have the elegant property described next.

As derived in (7), the spacetime spectrum P(Ω,Φ) generated by a plane wave with angle of arrival α is given by $$P(\Omega, \Phi) = S(\Omega)\delta\left(\Phi - \frac{\cos\alpha}{c}\Omega\right) \tag{35}$$

where S(Ω) is the temporal-frequency spectrum of the source signal s(t). Consider that p(t,x) has F plane-wave components, $p_0(t,x), \ldots, p_{F-1}(t,x)$, such that $$p(t, x) = \sum_{k=0}^{F-1} p_k(t, x) \tag{36}$$

The linearity of the Fourier transform implies that $$P(\Omega, \Phi) = \sum_{k=0}^{F-1} S_k(\Omega)\delta\left(\Phi - \frac{\cos\alpha_k}{c}\Omega\right) \tag{37}$$

Note that, according to (37), the higher the number of plane-wave components, the more dispersed the energy is in the spacetime spectrum. This provides good intuition on why a source in near-field generates a spectrum with more dispersed energy then a source in far-field: in near-field, the curvature is more stressed, and therefore has more plane-wave components.

As mentioned before, we are discarding spatial-frequency masking effects in this analysis, i.e., we are assuming there is total separation of the plane waves by the auditory system. Under this assumption, $$M(\Omega, \Phi) = \sum_{k=0}^{F-1} \mathbb{M}[S_k(\Omega)]\delta\left(\Phi - \frac{\cos\alpha_k}{c}\Omega\right) \tag{38}$$

or, in discrete-spacetime, $$M = \sum_{k=0}^{F-1} \mathbb{M}[S_{k,b_n}]\delta_{b_n, \frac{c}{\cos\alpha_k} b_m} \tag{39}$$

If p(t,x) has an infinite number of plane-wave components, which is usually the case, the masking curves can be estimated for a finite number of components, and then interpolated to obtain M.

Quantization

The main purpose of the psychoacoustic model, and the matrix M, is to determine the quantization step $\Delta_{bn,bm}$ required for quantizing each spectral coefficient $Y_{bn,bm}$, so that the quantization noise is lower than $M_{bn,bm}$. If the bitrate decreases, the quantization noise may increase beyond M to compensate for the reduced number of available bits. Within the scope of the present invention, several quantization schemes are possible some of which are presented, as non-limitative examples, in the following. The following discussion assumes, among other things, that $p_{n,m}$ is encoded with maximum quality, which means that the quantization noise is strictly bellow M. This is not however a limitation of the invention.

Another way of controlling the quantization noise, which we adopted for the WFC, is by setting $\Delta_{b_n,b_m}=1$ for all $b_n$ and $b_m$, and scaling the coefficients $Y_{bn,bm}$ by a scale factor $SF_{bn,bm}$, such that $SF_{bn,bm}Y_{bn,bm}$ falls into the desired integer. In this case, given that the quantization noise power equals $\Delta^2/12$, $$SF_{b_n,b_m} = \sqrt{12M_{b_n,b_m}} \tag{40}$$

The quantized spectral coefficient $Y_{bn,bm}{}^{Q}$ is then $$Y^{Q}_{b_n,b_m} = \mathrm{sign}(Y_{b_n,b_m}) \cdot \left\lfloor (SF_{b_n,b_m} \cdot |Y_{b_n,b_m}|)^{\frac{3}{4}} \right\rfloor \tag{41}$$

where the factor ¾ is used to increase the accuracy at lower amplitudes. Conversely, $$Y_{b_n,b_m} = \mathrm{sign}(Y^{Q}_{b_n,b_m}) \cdot \left( \frac{1}{SF_{b_n,b_m}} \cdot |Y^{Q}_{b_n,b_m}|^{\frac{4}{3}} \right) \tag{42}$$

It is not generally possible to have one scale factor per coefficient. Instead, a scale factor is assigned to one critical band, such that all coefficients within the same critical band are quantized with the same scale factor. In WFC, the critical bands are two-dimensional, and the scale factor matrix SF is approximated by a piecewise constant surface.

Huffman Coding

After quantization, the spectral coefficients are preferably converted into binary base using entropy coding, for example, but not necessarily, by Huffman coding. A Huffman codebook with a certain range is assigned to each spatio-temporal critical band, and all coefficients in that band are coded with the same codebook.

The use of entropy coding is advantageous because the MDCT has a different probability of generating certain values. An MDCT occurrence histogram, for different signal samples, clearly shows that small absolute values are more likely than large absolute values, and that most of the values fall within the range of −20 to 20. MDCT is not the only transformation with this property, however, and Huffman coding could be used advantageously in other implementations of the invention as well.

Preferably, the entropy coding adopted in the present invention uses a predefined set of Huffman codebooks that cover all ranges up to a certain value r. Coefficient bigger than r or smaller than −r are encoded with a fixed number of bits using Pulse Code Modulation (PCM). In addition, adjacent values $(Y_{bn},Y_{bn+1})$ are coded in pairs, instead of individually. Each Huffman codebook covers all combinations of values from $(Y_{bn},Y_{bn+1})=(-r,-r)$ up to $(Y_{bn},Y_{bn+1})=(r,r)$.

According to an embodiment, a set of 7 Huffman codebooks covering all ranges up to [−7,7] is generated according to the following probability model. Consider a pair of spectral coefficients $y=(Y_0,Y_1)$, adjacent in the Ω-axis. For a codebook of range r, we define a probability measure P[y] such that $$\mathbb{P}[y] = \frac{\mathbb{W}[y]}{\sum_{Y_0=-r}^{r} \sum_{Y_1=-r}^{r} \mathbb{W}[y]} \tag{43}$$

where $$\mathbb{W}[y] = \frac{1}{\mathbb{E}[|y|] + \mathbb{V}[|y|] + 1} \tag{44}$$

The weight of y, W[y], is inversely proportional to the average E[|y|] and the variance V[|y|], where $|y|=(|Y_0|,|Y_1|)$. This comes from the assumption that y is more likely to have both values $Y_0$ and $Y_1$ within a small amplitude range, and that y has no sharp variations between $Y_0$ and $Y_1$.

When performing the actual coding of the spectral block Y, the appropriate Huffman codebook is selected for each critical band according to the maximum amplitude value $Y_{bn,bm}$ within that band, which is then represented by r. In addition, the selection of coefficient pairs is performed vertically in the Ω-axis or horizontally in the Φ-axis, according to the one that produces the minimum overall weight W[y]. Hence, if $v=(Y_{bn,bm},Y_{bn+1,bm})$ is a vertical pair and $h=(Y_{bn,bm},Y_{bm,bm+1})$ is an horizontal pair, then the selection is performed according to $$\min_{v,h}\left\{ \sum_{b_n,b_m} \mathbb{W}[v], \sum_{b_n,b_m} \mathbb{W}[h] \right\}.$$

If any of the coefficients in y is greater than 7 in absolute value, the Huffman codebook of range 7 is selected, and the exceeding coefficient $Y_{bn,bm}$ is encoded with the sequence corresponding to 7 (or −7 if the value is negative) followed by the PCM code corresponding to the difference $Y_{b_n,b_m}-7$.

As we have discussed, entropy coding provides a desirable bitrate reduction in combination with certain filter banks, including MDCT-based filter banks. This is not, however a necessary feature of the present invention, that covers also methods and systems without a final entropy coding step.

Bitstream Format

According to another aspect of the invention, the binary data resulting from an encoding operation are organized into a time series of bits, called the bitstream, in a way that the decoder can parse the data and use it reconstruct the multichannel signal p(t,x). The bitstream can be registered in any appropriate digital data carrier for distribution and storage.

Figure 5:
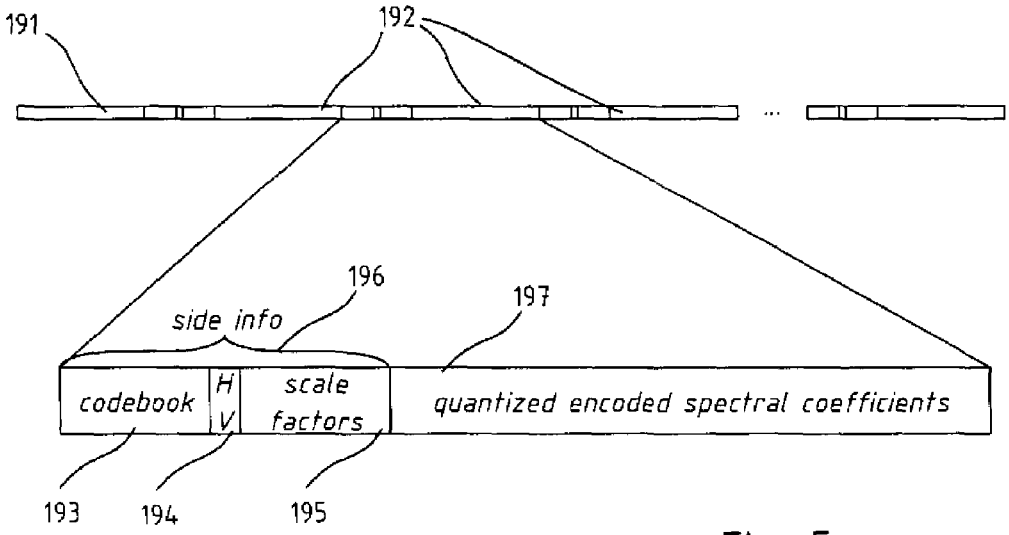
FIG. 5 illustrates a possible format of a bitstream containing wave field data and side information encoded according to the inventive method.

FIG. 5 illustrates a possible and preferred organization of the bitstream, although several variants are also possible. The basic components of the bitstream are the main header, and the frames 192 that contain the coded spectral data for each block. The frames themselves have a small header 195 with side information necessary to decode the spectral data.

The main header 191 is located at the beginning of the bitstream, for example, and contains information about the sampling frequencies $\Omega_S$ and $\Phi_S$, the window type and the size $B_n \times B_m$ of spatio-temporal MDCT, and any parameters that remain fixed for the whole duration of the multichannel audio signal. This information may be formatted in different manners.

The frame format is repeated for each spectral block $Y_{g,l}$, and organized in the following order:

$$Y_{0,0} \ldots Y_{0,K_l-1} Y_{K_g-1,0} \ldots Y_{K_g-1,K_l-1},$$

such that, for each time instance, all spatial blocks are consecutive. Each block $Y_{g,l}$ is encapsulated in a frame 192, with a header 196 that contains the scale factors 195 used by $Y_{g,l}$ and the Huffman codebook identifiers 193.

The scale factors can be encoded in a number of alternative formats, for example in logarithmic scale using 5 bits. The number of scale factors depends on the size $B_m$ of the spatial MDCT, and the size of the critical bands.

Decoding

The decoding stage of the WFC comprises three steps: decoding, re-scaling, and inverse filter-bank. The decoding is controlled by a state machine representing the Huffman codebook assigned to each critical band. Since Huffman encoding generates prefix-free binary sequences, the decoder knows immediately how to parse the coded spectral coefficients. Once the coefficients are decoded, the amplitudes are re-scaled using (42) and the scale factor associated to each critical band. Finally, the inverse MDCT is applied to the spectral blocks, and the recombination of the signal blocks is obtained through overlap-and-add in both temporal and spatial domains.

The decoded multi-channel signal $p_{n,m}$ can be interpolated into p(t,x), without loss of information, as long as the anti-aliasing conditions are satisfied. The interpolation can be useful when the number of loudspeakers in the playback setup does not match the number of channels in $p_{n,m}$.

The inventors have found, by means of realistic simulation that the encoding method of the present invention provides substantial bitrate reductions with respect to the known methods in which all the channels of a WFC system are encoded independently from each other.

The invention claimed is:

1. Method for encoding a plurality of audio channels comprising the steps of: applying to said plurality of audio channels a two-dimensional filter-bank along both the time dimension and the channel dimension resulting in two-dimensional spectra; coding said two-dimensional spectra, resulting in coded spectral data, organizing said plurality of audio channels into a two-dimensional signal with time dimension and channel dimension, wherein said two-dimensional spectra and said coded spectral data represent transform coefficients in a four-dimensional uniform or non-uniform tiling, comprising the temporal-index of the block, the channel-index of the block, the temporal frequency dimension, and the spatial frequency dimension.

2. The method of claim 1, wherein the plurality of audio channels contains values of a wave field at a plurality of positions in space and time, and the two-dimensional spectra contains transform coefficients relating to a temporal-frequency value and a spatial-frequency value.

3. The method of claim 2, wherein the values of the wave field are measured values or synthesized values.

4. The method of claim 1, wherein the coding step comprises a step of quantizing the two-dimensional spectra into a quantized spectral data, said quantizing based upon a masking model of the frequency masking effect along the temporal frequency and/or the spatial frequency.

5. The method of claim 4, wherein said masking model comprises the frequency masking effect along both the temporal-frequency and the spatial frequency, and is based on a two-dimensional masking function of the temporal frequency and of the spatial frequency.

6. The method of claim 1, further including a step of including the coded spectral data and side information necessary to decode said coded spectral data into a bitstream.

7. The method of claim 1, wherein the steps of transforming and coding said two-dimensional signal are executed in two-dimensional signal blocks of variable size.

8. The method of claim 7, wherein said two-dimensional signal blocks are overlapped by zero or more samples in both the time dimension and the channel dimension.

9. The method of claim 7, wherein said two-dimensional filter-bank is applied to said two-dimensional signal blocks, resulting in two dimensional spectral blocks.

10. The method of claim 1, further comprising a step of obtaining said plurality of audio channels by measuring values of a wave field with a plurality of transducers at a plurality of locations in time and space.

11. The method of claim 1, further comprising a step of synthesizing said plurality of audio channels by calculating values of a wave field at a plurality of locations in time and space.

12. The method of claim 1, wherein the two dimensional filter bank computes a Modified Discrete Cosine Transform (MDCT), a cosine transform, a sine transform, a Fourier Transform, or a wavelet transform.

13. The method of claim 1, further comprising a step of computing loudspeaker drive signals by processing the two-dimensional signal or the two-dimensional spectra.

14. The method of claim 13, wherein said loudspeaker drive signals are computed by a filtering operation in the time domain or in the frequency domain.

15. Method for decoding a coded set of data representing a plurality of audio channels comprising the steps of: obtaining a reconstructed two-dimensional spectra from the coded data set;

transforming the reconstructed two-dimensional spectra with a two-dimensional inverse filter-bank, wherein said reconstructed two-dimensional spectra represent transform coefficients in a four-dimensional uniform or non-uniform tiling, comprising the time-index of the block, the channel-index of the block, the temporal frequency dimension, and the spatial frequency dimension.

16. The method of claim 15, wherein the reconstructed two-dimensional spectra comprise transform coefficients relating to a temporal-frequency value and a spatial-frequency value, and in which the step of transforming with a two-dimensional inverse filter bank provides a plurality of audio channels containing values of a wave field at a plurality of positions in space and time.

17. The method of claim 15, wherein said coded set of data is extracted from a bitstream, and decoded with the aid of side information extracted from the bitstream.

18. The method of claim 15, wherein said reconstructed two-dimensional spectra is relative to reconstructed two-dimensional signal blocks of variable size.

19. The method of claim 18, wherein said reconstructed two-dimensional signal blocks are overlapped by zero or more samples in both the time dimension and the space dimension.

20. The method of claim 18, wherein said two-dimensional inverse filter-bank is applied to reconstructed two-dimensional spectra, resulting in said reconstructed two-dimensional signal blocks.

21. The method of claim 15, wherein the two-dimensional inverse filter bank computes an inverse Modified Discrete Cosine Transform (MDCT), or an inverse Cosine transform, or an inverse Sine transform, or an inverse Fourier Transform, or an inverse wavelet transform.

22. An encoding device, operatively arranged to carry out the method of claim 1.

23. A non-transitory digital carrier on which is recorded an encoding software loadable in the memory of a digital processor, containing instructions to carry out the method of claim 1.

24. A decoding device, operatively arranged to carry out the method of claim 15.

25. A non-transitory digital carrier on which is recorded a decoding software loadable in the memory of a digital processor, containing instructions to carry out the method of claim 15.

26. An acoustic reproduction system comprising:

a digital decoder, for decoding a bitstream representing samples of an acoustic wave field or loudspeaker drive signals at a plurality of positions in space and time, the decoder including an entropy decoder, operatively arranged to decode and decompress the bitstream, into a quantized two-dimensional spectra, and a quantization remover, operatively arranged to reconstruct a two-dimensional spectra containing transform coefficients relating to a temporal-frequency value and a spatial-frequency value, said quantization remover applying a masking model of the frequency masking effect along the temporal frequency and/or the spatial frequency, and a two-dimensional inverse filter-bank, operatively arranged to transform the reconstructed two-dimensional spectra into a plurality of audio channels;

a plurality of loudspeaker or acoustical transducers arranged in a set disposition in space, the positions of the loudspeakers or acoustical transducers corresponding to the position in space of the samples of the acoustic wave field;

one or more Digital-to-Analog Converters (DACs) and signal conditioning units, operatively arranged to extract a plurality of driving signals from plurality of audio channels, and to feed the driving signals to the loudspeakers or acoustical transducers, wherein said reconstructed two-dimensional spectra represent transform coefficients in a four-dimensional uniform or non-uniform tiling, comprising the time-index of the block, the channel-index of the block, the temporal frequency dimension, and the spatial frequency dimension, the system further comprising an interpolating unit, for providing an interpolated acoustic wave field signal.

27. An acoustic recording system comprising:

a plurality of microphones or acoustical transducers arranged in a set disposition in space to sample an acoustic wave field at a plurality of locations;

one or more Analog-to-Digital Converters (ADCs), operatively arranged to convert the output of the microphones or acoustical transducers into a plurality of audio channels containing values of the acoustic wave field at a plurality of positions in space and time;

a digital encoder, including a two-dimensional filter bank operatively arranged to transform the plurality of audio channels into a two-dimensional spectra containing transform coefficients relating to a temporal-frequency value and a spatial-frequency value, a quantizing unit, operatively arranged to quantize the two-dimensional spectra into a quantized two-dimensional spectra, said quantizing applying a masking model of the frequency masking effect along the temporal frequency and/or the spatial frequency, and an entropy coder, for providing a compressed bitstream representing the acoustic wave field or the loudspeaker drive signals;

a digital storage unit for recording the compressed bitstream, a windowing unit, operatively arranged to partition the time dimension and/or the spatial dimension in a series of two-dimensional signal blocks;

wherein said two-dimensional spectra represent frequency coefficients in a four-dimensional uniform or non-uniform tiling, comprising the time-index of the block, the channel-index of the block, the temporal frequency dimension, and the spatial frequency dimension.

28. A non-transitory digital carrier containing an encoded bitstream representing a plurality of audio channels including a series of frames corresponding to two-dimensional signal blocks, each frame comprising:

entropy-coded spectral coefficients of the represented wave field in the corresponding two-dimensional signal block, the spectral coefficients being quantized according to a two-dimensional masking model, and allowing reconstruction of the wave field or the loudspeaker drive signal by a two-dimensional filter-bank, side information necessary to decode the spectral data, wherein said reconstructed two-dimensional spectra represent transform coefficients in a four-dimensional uniform or non-uniform tiling, comprising the time-index of the block, the channel-index of the block, the temporal frequency dimension, and the spatial frequency dimension.

* * * * *